US005803120A

United States Patent [19]

Bertoli

[11] Patent Number: 5,803,120

[45] Date of Patent: Sep. 8, 1998

[54] FAUCETS FOR SANITARY FIXTURES WITH INTERCHANGEABLE DECORATIVE ELEMENTS

[75] Inventor: Franco Bertoli, Milan, Italy

[73] Assignee: American Standard Inc., Piscataway, N.J.

[21] Appl. No.: 589,225

[22] Filed: Jan. 22, 1996

[30] Foreign Application Priority Data

Jan. 24, 1995 [IT] Italy ..... RE954003 U

[51] Int. Cl.[6] ..... F16L 5/00

[52] U.S. Cl. ..... 137/801; 4/678

[58] Field of Search ..... 137/801, 375; 4/678

[56] References Cited

U.S. PATENT DOCUMENTS 3,590,876 7/1971 Young ..... 137/801

4,387,738 6/1983 Bisonaya et al. ..... 137/801

5,027,851 7/1991 Dreer et al. ..... 137/801

5,165,121 11/1992 Mc Tarrgett et al. ..... 137/801

*Primary Examiner*—A. Michael Chambers

[57] ABSTRACT

A faucet comprises an externally unfinished hydraulic apparatus comprising at least one water delivery conduit and water regulation means. The hydraulic apparatus is at least partly covered with sheathing elements in the form of rigid shells capable of defining the external appearance of the faucet. The sheathing elements are provided with shaped elements capable of meeting corresponding parts of the hydraulic apparatus to determine the correct position of the sheathing elements with respect to the hydraulic apparatus. Connecting means are provided for fastening the sheathing elements to one another and to the hydraulic apparatus.

6 Claims, 4 Drawing Sheets

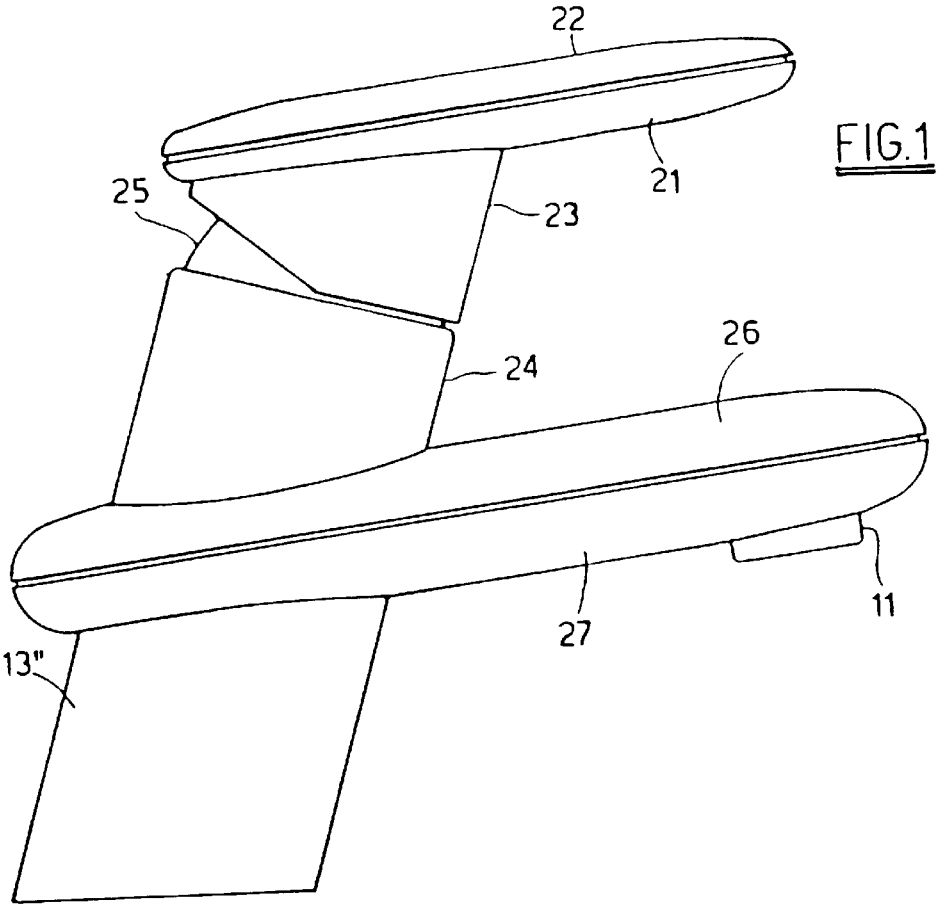
FIG.1
FIG.2
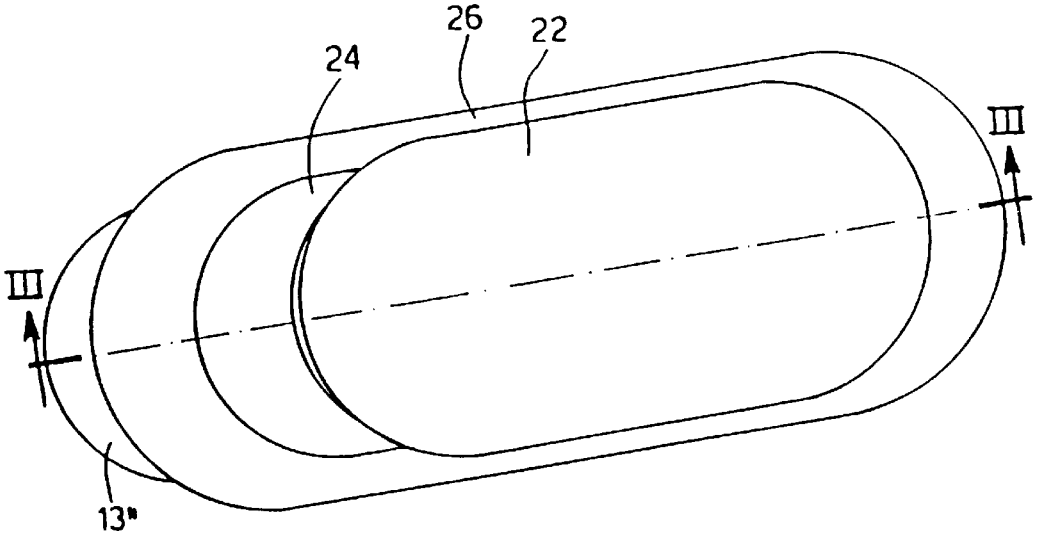

FAUCETS FOR SANITARY FIXTURES WITH INTERCHANGEABLE DECORATIVE ELEMENTS

BACKGROUND OF THE INVENTION

The present invention is directed to faucets for sanitary fixtures, and in particular to faucets having interchangeable decorative elements.

In addition to the function of delivering water, much value and attention is directed to the decorative appearance of faucets since faucets also perform a substantial ornamental function, as components of the bathroom furniture. Generally, the metal body, which comprises the water outlet opening and the valve means for the regulation of the flow rate and mixing process of hot and cold water, also encompasses the ornamental features of the faucet. The metal body is shaped and worked or treated externally, and, together with the handle or handles of the regulation means, defines the decorative appearance of the faucet.

To change the decorative appearance of a faucet, it is usually necessary to change the metal body and the handle which constitute essentially the entire faucet. Thus, if users wish to change the decorative appearance of their own faucets, they must acquire another faucet and thus, pay the purchase price thereof. Moreover, stores must keep in stock a relatively large quantity of faucets in order to have several models with different decorative appearances available. For example, if a model comes in a variety of different colors, a corresponding number of faucets in each color should be kept in stock. The same requirements apply to the stocking of components by the manufacturer.

Thus, it is apparent that a new type of faucet is desirable in order to provide consumers with more options in design and ornamentation without involving the cost of a new faucet.

SUMMARY OF THE INVENTION

It is therefore an object of the invention to provide options in design and ornamentation of faucets without requiring replacement of the entire faucet.

This object along with other objects and advantages is achieved by the present invention which provides for a faucet having an externally unfinished hydraulic apparatus, of unified or standard shape, comprising a water regulation means and a delivery outlet, which performs only the technical function. The decorative function of the faucet, however, is performed by sheathing elements in the form of shells, made of synthetic material, which are positioned to cover all or part of the hydraulic apparatus and which define the decorative appearance of the faucet. These sheathing elements are arranged on the hydraulic apparatus by means of shaped elements which act as meeting points and are fastened to it with a simple connecting means, such as, for example, screws or other simple coupling means.

These sheathing elements can be replaced by others which are similar thereto, but have a different color, finish, or shape. Thus, a single hydraulic apparatus, which is the most costly part of the faucet to design, can take on different decorative appearances simply by installing therein sheathing elements which differ from one another in terms of shape, color, or finish, and which are inherent of extremely modest cost.

The manufacturer or dealer can maintain in stock a single model of a hydraulic apparatus (which, as stated above, represents the most costly component), together with various sheathing elements (which will have a relatively low cost) so as to make different models of a faucet available. In addition, users who wish to change the decorative appearance of their faucets can retain the hydraulic apparatus and change only the sheathing elements.

BRIEF DESCRIPTION OF THE DRAWINGS

The invention will be more fully appreciated from the following detailed description when the same is considered in connection with the accompanying drawings in which:

FIG. 1 is a side view of a faucet in accordance with the claimed invention, showing a model for a sink or bidet;

FIG. 2 is a top plan view of the faucet in FIG. 1;

DETAILED DESCRIPTION OF THE INVENTION

Figure 3:
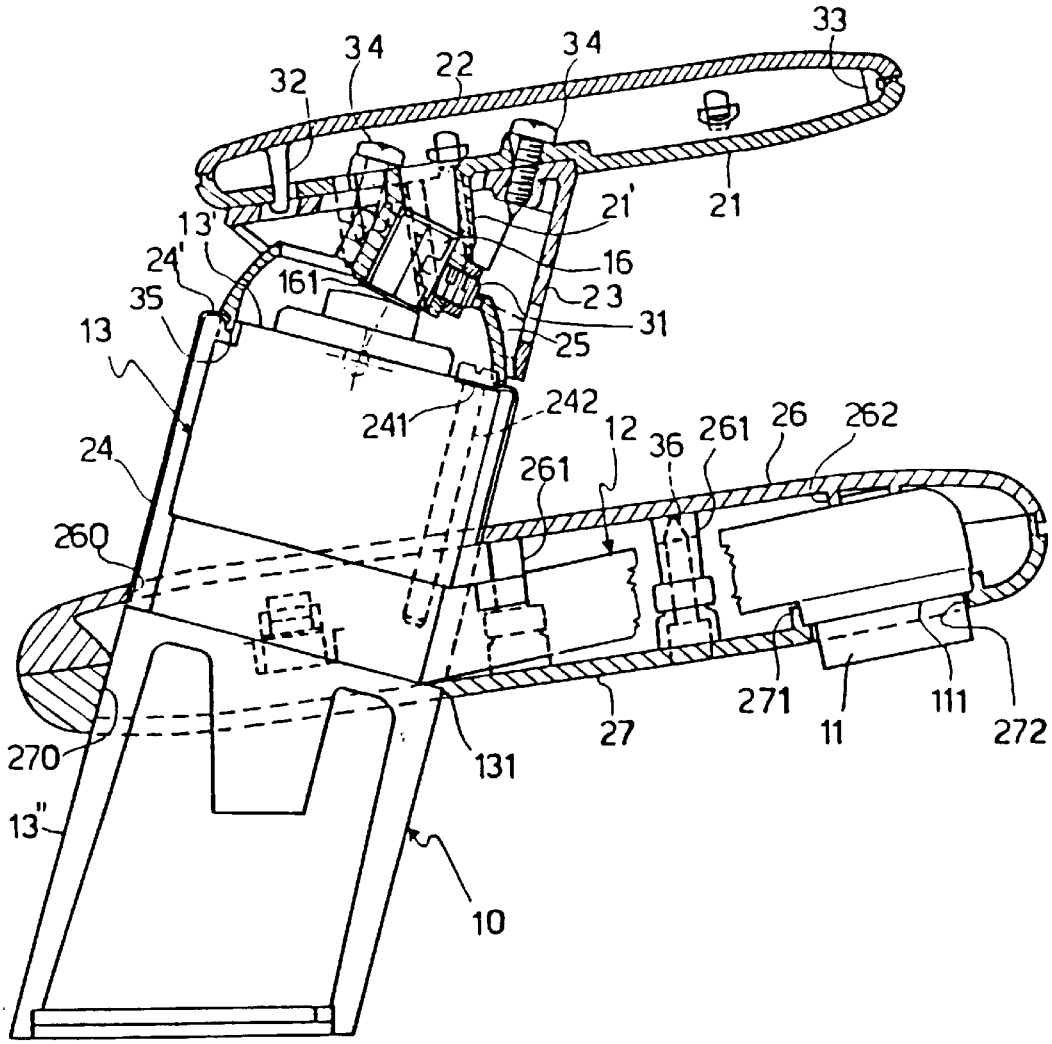
FIG. 3 is a sectional view along plane III—III of FIG. 2.
Figure 4:
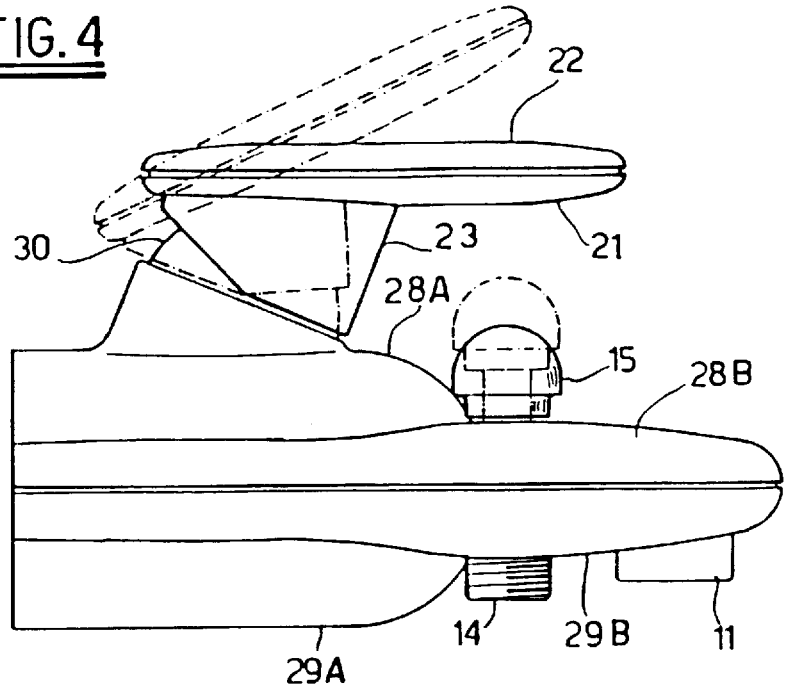
FIG. 4 is a side view of a faucet in accordance with the claimed invention, showing a model for a bathtub.
Figure 5:
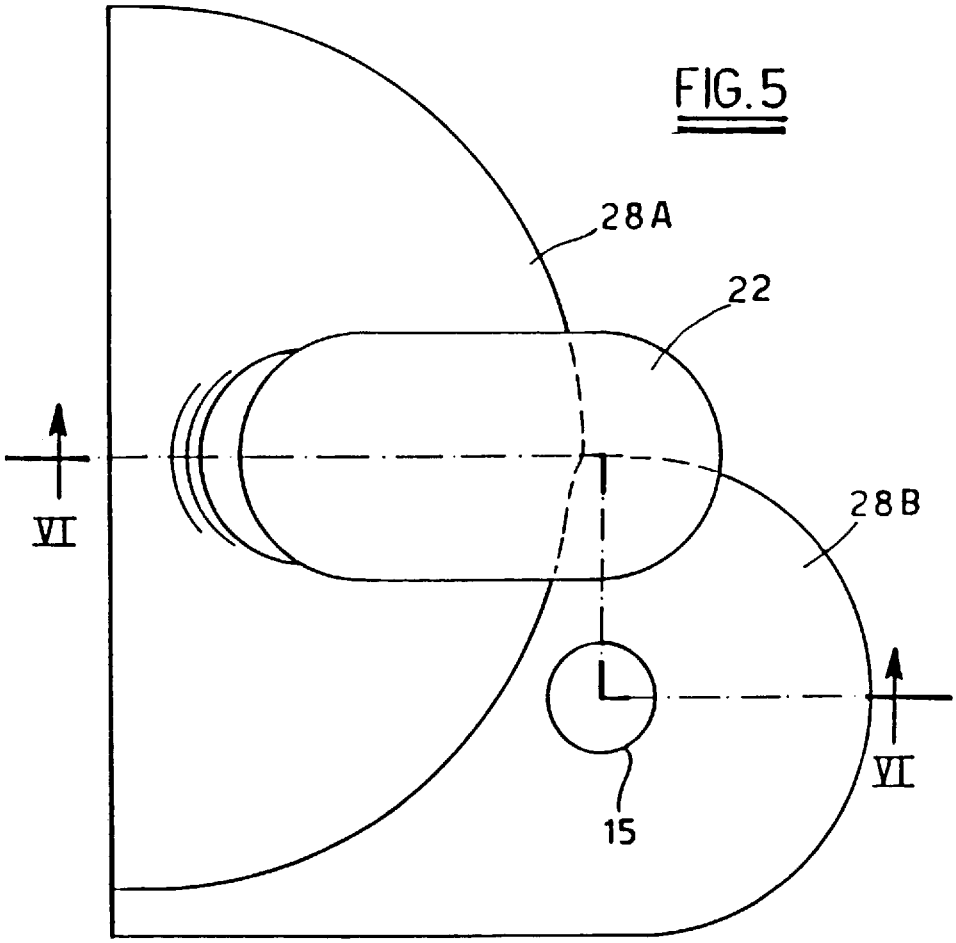
FIG. 5 is a top plan view of the faucet in FIG. 4.
Figure 6:
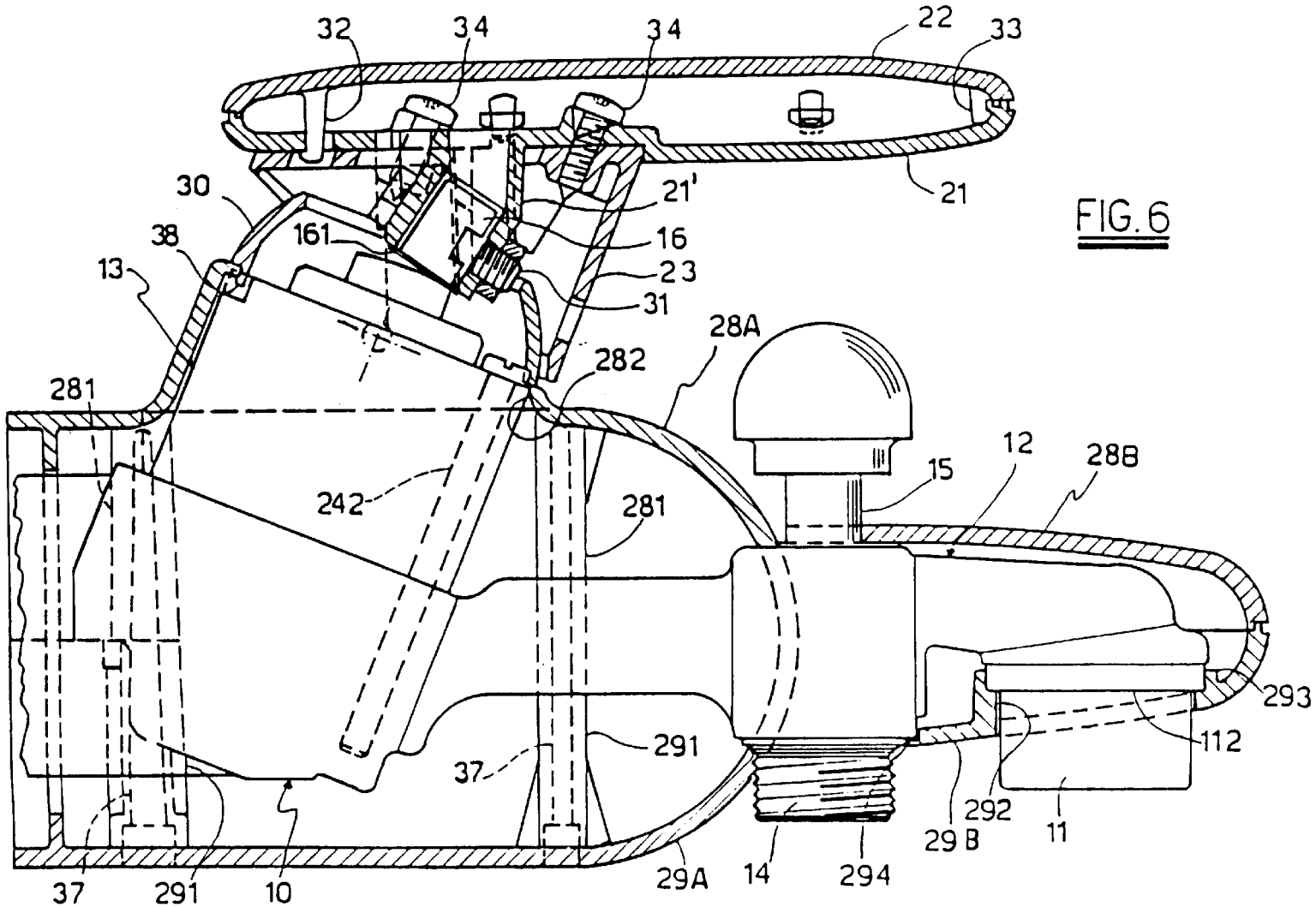
FIG. 6 is a sectional view along plane VI—VI of FIG. 5.

Reference is now made to FIGS. 1 through 6 which depict a faucet which includes a hydraulic apparatus, indicated at 10. It performs only the technical function of the faucet, namely to deliver and regulate the flow and mixing of hot and cold water. The hydraulic apparatus is illustrated in FIGS. 3 and 6, schematically and externally. Apparatus 10 comprises an ordinary delivery conduit 12 having an outlet opening 11. Conduit 12 branches off from a standard valve body 13 which is joined to the household plumbing system, provides hot and cold water, and contains therein a standard internal means for regulating the water, namely, a means for mixing the hot and cold water, and a means for regulating the flow emerging from opening 11.

Provided in the faucet illustrated in FIGS. 4 through 6 is a standard second water outlet opening 14, capable of being joined to a flexible tube for a hand-held showerhead (not depicted). In this case an ordinary diverter valve 15, placed on conduit 12, is provided in order to divert water to opening 11 or alternatively, to opening 14. As already mentioned above, associated with hydraulic apparatus 10, are sheathing elements in the form of rigid shells, made, in particular, of synthetic material such as, for example, ABS (acrylonitrile butadiene styrene), capable of at least partly covering apparatus 10 and defining the decorative appearance of the faucet.

In the two embodiments illustrated in the Figures, there is placed at the upper end of body 13 a stem 16 which projects upwardly and controls the means for mixing and regulating the water flow which is placed within body 13. The invention provides for sheathing elements made up of a plurality of concave shells that can be assembled to one another, which cover stem 16 and are fastened thereto and, moreover, define an internally hollow body that forms the handle for moving stem 16.

In detail, there is provided a shell 21, substantially flat, with its concavity facing upward, which possesses a lower tubular appendage 21' that mates with stem 16 and is fastened to the same by means of a screw 31. The correct position of shell 21 with respect to stem 16 is determined by the lower edge of appendage 21' which comes into contact with a collar 161 of stem 16, and by the coupling between screw 31 and the respective hole provided in stem 16. Placed on shell 21 is a second shell 22, having its concavity facing downward and substantially symmetrically identical to shell 21. The two shells 21 and 22 mate with one another along their respective edges, which have a section such as to fit into one another, and are reciprocally joined by means of snap hooks 32 and 33. The two shells 21 and 22 together define a hollow body which forms the handle of the faucet to move stem 16. Also provided is another, tubular shell 23, fastened beneath shell 21, that surrounds and conceals appendage 21'. Shell 23 is fastened to the lower surface of shell 21 by means of screws 34, whose heads remain enclosed between shells 21 and 22.

In FIGS. 1 through 3, which depict the model for a sink or bidet, the upper part of body 13 is covered by a thin tubular cylindrical shell 24 with upper edge 24' bent inwardly and to meet with the edge of upper surface 13' of body 13. Shell 24 is fastened to body 13 by means of screws 242 which are inserted axially into body 13, the heads of which engage with small lugs 241 branching off from upper edge 24'. Joined to the upper edge 24' of shell 24 is another shell 25 located inside shell 23, which surrounds and conceals the upper part of body 13. Shell 25 is provided with small snap hooks 35 which engage edge 24' of shell 24. The lower part 13' of the lateral surface of body 13 is visible, and will be appropriately finished or treated so as to acquire the desired decorative appearance.

Delivery conduit 12 is covered with an upper shell 26 and a lower shell 27, which are complementary and assembled to one another. Lower shell 27 possesses a hole 272 through which outlet opening 11 passes. In addition, shells 26 and 27 possess respective clearance holes 260 and 270 through which shell 24 and the lower part 13" of body 13 pass. The two shells 26 and 27 mate with one another along their respective edges, which have a stepped cross section so as to give rise to reciprocal embedding. Additionally, they are joined to one another by means of screws 36, each of which has a head which is housed in a seat located in lower shell 27 and a shank which engages in a hole present in a projection 261 that descends from the inner surface of shell 26.

The correct position of shells 26 and 27 with respect to the hydraulic apparatus is determined by a plurality of shaped elements provided on the shells, which meet with corresponding parts of the hydraulic apparatus. In particular, projecting from the inner surface of lower shell 27 is a salient edge 271, with a stepped cross section, placed around hole 272, which mates with a corresponding stepped edge 111 provided on the lateral surface of outlet opening 11. Additionally, projecting downwardly from the inner surface of upper shell 26 are elements 262 which rest against the upper surface of conduit 12. Moreover, the edges of the two holes 270 and 260 are shaped so as to mate with the lateral surface of body 13 and shell 24, respectively. The faucet can also provide a control lever for the device closing the drain of the sink or bidet ("lift rod"). This lever (not illustrated in the Figures) will pass through the rear part of shell 26 and 27 and the lower part of body 13.

Attention is directed to FIGS. 4 through 6 which depict a model for a bathtub. Body 13, conduit 12 and valve 15 are enclosed and covered by two casings, A and B, each composed of an upper shell 28A and 28B, respectively, and a lower shell 29A and 29B, respectively, which are complementary and can be assembled to one another along a median horizontal joining plane. Casing A is anteriorly rounded and encloses body 13. Casing B is located alongside casing A, is not as high or thick as casing A, and encloses conduit 12.

Shells, 28A and 29A, and shells 28B and 29B, mate with one another along their respective edges, which have stepped cross sections which give rise to reciprocal embedding. Moreover, the shells are joined to one another by means of screws 37, each of which passes through element 291 projecting from the inner surface of lower shell 29 and engages in a hole present in an element 281 projecting from the inner surface of upper shell 28. Lower shell 29B possesses one hole 292 and one hole 294 through which pass outlet opening 11 and second opening 14, respectively.

The correct position of shells 28A, 28B, 29A and 29B, is determined by shaped elements provided on these shells, which meet corresponding parts of the hydraulic apparatus. In particular, projecting from the inner surface of lower shell 29B is a salient edge 293 with a stepped cross section, located around hole 292, which mates with a corresponding stepped edge 112 provided on the lateral surface of opening 11. The edge of hole 294, mating with the lateral surface of conduit 14, also functions as a meeting element. In addition, upper shell 28A possesses a hole 282 which substantially fits together with the upper base of body 13 and functions as a meeting element. The upper edge of shell 28A around hole 282 is bent inwardly, and is joined to another shell 30, located internally with respect to shell 23, which surrounds and conceals the upper part of body 13. This shell 30 possesses small snap hooks 38 which engage with the edge of hole 282.

All the shells described are interchangeable with others that are similar but have a different color, finish, or decorative appearance. This is particularly true for the shells which form the handle of the faucet, and those which cover the delivery opening of the faucet.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A faucet for sanitary fixtures with interchangeable decorative elements to define the external appearance of the faucet, comprising:

an externally unfinished hydraulic apparatus including at least one water delivery conduit and a water regulation means having a control stem;

a plurality of sheathing elements for covering said hydraulic apparatus, said sheathing elements defining said external appearance of said faucet, said sheathing elements including mating pairs of reciprocally assembled complementary concave shells which together form a handle to move said control stem and for covering the water delivery conduit, said sheathing elements also including at least one tubular shell for covering said control stem; and, connecting means for fastening said sheathing elements to said hydraulic apparatus.

2. The faucet according to claim 1 wherein said sheathing elements comprise a plurality of concave shells capable of being assembled to one another and capable of encompassing the delivery conduit and fastening thereto.

3. The faucet according to claim 2 wherein said shells are made of a rigid synthetic material.

4. The faucet according to claim 3 wherein said shells comprise a salient edge and elements projecting from an inner surface of said shells to position said hydraulic apparatus within said shells.

5. The faucet according to claim 4 wherein said salient edge comprises a stepped cross section and said delivery conduit comprises a stepped edge to mate with said stepped cross section.

6. The faucet according to claim 5 wherein said shells which form said handle are fitted to one another by means of snap hooks.

* * * * *